US007836668B2

(12) United States Patent
Van Gilder

(10) Patent No.: US 7,836,668 B2
(45) Date of Patent: Nov. 23, 2010

(54) METHOD OF PACKING AND SHIPPING EROSION CONTROL BLANKETS

(75) Inventor: Rocky Van Gilder, Rice Lake, WI (US)

(73) Assignee: American Excelsior Company, Arlington, TX (US)

( * ) Notice: Subject to any disclaimer, the term of this patent is extended or adjusted under 35 U.S.C. 154(b) by 119 days.

(21) Appl. No.: 12/274,090

(22) Filed: Nov. 19, 2008

(65) Prior Publication Data

US 2009/0183468 A1 Jul. 23, 2009

Related U.S. Application Data

(60) Provisional application No. 61/003,770, filed on Nov. 20, 2007.

(51) Int. Cl.
*B65B 3/26* (2006.01)

(52) U.S. Cl. ..... 53/475; 53/430; 53/443; 53/444

(58) Field of Classification Search ..... 53/473, 53/475, 397, 399, 428, 430, 443, 444
See application file for complete search history.

(56) References Cited

U.S. PATENT DOCUMENTS

| | | | | | |
|---|---|---|---|---|---|
| 3,747,743 | A * | 7/1973 | Hoffmann, Jr. | ..... | 206/321 |
| 3,861,538 | A * | 1/1975 | Locke | ..... | 410/155 |
| 4,353,946 | A * | 10/1982 | Bowers | ..... | 428/109 |
| 4,506,492 | A * | 3/1985 | Boyd | ..... | 53/473 |
| 4,635,576 | A * | 1/1987 | Bowers | ..... | 112/403 |
| 5,484,501 | A * | 1/1996 | Jacobsen et al. | ..... | 156/209 |
| 5,735,982 | A | 4/1998 | Prunty et al. | | |
| 5,829,231 | A * | 11/1998 | Harding et al. | ..... | 53/493 |
| 5,876,318 | A * | 3/1999 | Ratzel | ..... | 493/30 |
| 6,855,650 | B1 * | 2/2005 | Bohannon, Jr. | ..... | 442/32 |
| 7,415,923 | B2 * | 8/2008 | Starrett et al. | ..... | 100/3 |
| 2006/0093441 | A1 * | 5/2006 | Starrett et al. | ..... | 405/302.7 |
| 2006/0127182 | A1 * | 6/2006 | Sanguinetti | ..... | 405/20 |
| 2010/0064635 | A1 * | 3/2010 | Jensen et al. | ..... | 53/429 |

* cited by examiner

*Primary Examiner*—Christopher Harmon
(74) *Attorney, Agent, or Firm*—Winstead PC

(57) ABSTRACT

A method of packing and shipping erosion control blankets that maximizes the use of the interior space of a shipping container. More particularly, but not by way of limitation, the method relates to packing, handling, storing and shipping of erosion control blankets adapted for delivery to customers in generally cylindrical, rolled configurations.

33 Claims, 7 Drawing Sheets

METHOD OF PACKING AND SHIPPING EROSION CONTROL BLANKETS

CROSS-REFERENCE TO RELATED APPLICATIONS

This patent application claims priority from, and incorporates by reference the entire disclosure of U.S. Provisional Patent Application No. 61/003,770, filed on Nov. 20, 2007.

BACKGROUND OF THE INVENTION

1. Field of the Invention

The present invention relates to the packing and shipping of erosion control blankets, and more particularly, but not by way of limitation, to the packing, handling, storing and shipping of erosion control blankets adapted for delivery to customers in generally cylindrical, rolled configurations.

2. History of the Prior Art

For both aesthetic and environmental control reasons, it is often necessary or desirable to grow ground vegetation such as, for example, grass, on flat land or slopes, channels, and bare earth areas to inhibit erosion due to effects of wind and rain. The successful sprouting and growth of ground vegetation planted on these areas, however, is often prevented by soil erosion which planted vegetation is designed to inhibit, the erosion frequently carrying away at least some portion of the soil before vegetation takes hold.

To alleviate this problem, it is now a common practice to cover the area with fibrous, mat-like members commonly referred to as erosion control blankets. Erosion control blankets in general are discussed in co-pending U.S. patent application Ser. No. 09/648,906, assigned to the assignee of the present invention. One particularly effective erosion control blanket is the CURLEX® or excelsior blanket manufactured and sold by the American Excelsior Company of Arlington, Tex. since 1964. This erosion control blanket is fabricated, in elongated rectangular mat form, from elongated, randomly intertwined fibers commonly referred to as excelsior or wood wool. The erosion control blanket assemblies are typically packaged in individually rolled bundles to facilitate their handling and transport to the erosion control job site. The cost of transportation is, therefore, a significant factor to be considered in the purchase of the erosion control blankets.

Once packed, shipped and delivered to the job site, the erosion control blanket bundles are unrolled in a side-to-side relationship along an earth area to be protected against erosion, and are secured along sides of one another and to an underlying ground area with a use of a spaced series of conventional ground staple members, which may be made of, for example, steel, wood, plastic, starch, or the like. The installed erosion control blankets generally have parallel sides and abut one another to form a substantially solid surface to shield the underlying earth area, and thus the planted ground vegetation therein, from wind and water erosion forces.

The individual fibers forming the mat portion of various types of the erosion control blankets collectively define therebetween a plurality of small interstitial regions through which the planted ground vegetation may upwardly sprout and grow. During such shielded vegetation growth, some varieties of the erosion control blankets, such as the CURLEX® blanket decompose, ultimately being replaced by the emerging ground vegetation.

The innovative approach to utilizing excelsior wood fibers in an erosion control blanket has been found to be both economically viable and environmentally effective for erosion control considerations. Due to the ever growing number of federal, state, and municipal regulations requiring protective measures in the area of erosion control, the shipment of and cost for delivery of such erosion control units has become increasingly important. Due to the size and length of the erosion blankets, such as the above referenced CURLEX® erosion control blanket, shipping and handling is of major concern for both the manufacturer and an ultimate user. When the erosion control blankets are packed for shipment in a less then efficient manner, the amount of space necessary for shipment will be less cost effective. A need therefore exists for a method of efficient, space-saving packaging and handling of erosion control blankets in a manner facilitating reduced cost and ease in storage, packing, and use.

BRIEF SUMMARY OF THE INVENTION

Disclosed is a method of packing, handling, and delivering a plurality of erosion control blankets of a type having a flexible mat of intertwined, elongated members. The method comprises assembling the plurality of erosion control blankets for packing; providing a shipping container having an interior width, an interior height, and an interior length; rolling each of the plurality of erosion control blankets into a generally cylindrical shape; grouping the rolled plurality of erosion control blankets into a plurality of bundles, each of the plurality of bundles having a height and width that is generally evenly divided into the interior height and width of the shipping container; and binding each of the plurality of bundles for subsequent handling.

In an alternative embodiment, a method of packing, handling, and delivering a plurality of erosion control blankets of the type having a flexible mat of intertwined, elongated members. the method comprises assembling the plurality of erosion control blankets for packing; providing a shipping container having an interior width and an interior height, wherein the interior width is generally an integer multiple of a number 3y and the interior height is generally an integer multiple of a number 2x; rolling each of the plurality of erosion control blankets into a generally cylindrical shape; grouping the rolled plurality of erosion control blankets into a plurality of bundles each having a height of generally x, and a width of generally y; and binding each of the plurality of bundles for subsequent handling.

In yet another alternative embodiment, a method of packing, handling, and delivering a plurality of erosion control blankets of the type having a flexible mat of intertwined, elongated members. The method comprises assembling the plurality of erosion control blankets for packing; providing a shipping container having an interior width, an interior height, and an interior length; rolling each of the plurality of erosion control blankets into a generally cylindrical shape having a length and a diameter; grouping the rolled plurality of erosion control blankets into a plurality of bundles, each of the plurality of bundles having a height, width, and length that is generally evenly divided into the interior height, width, and length of the shipping container; and binding each of the plurality of bundles for subsequent handling.

BRIEF DESCRIPTION OF THE DRAWINGS

The preferred embodiment of the invention will now be described, by way of example only, with reference to the accompanying drawings in which.

DETAILED DESCRIPTION OF THE INVENTION

Figure 1:
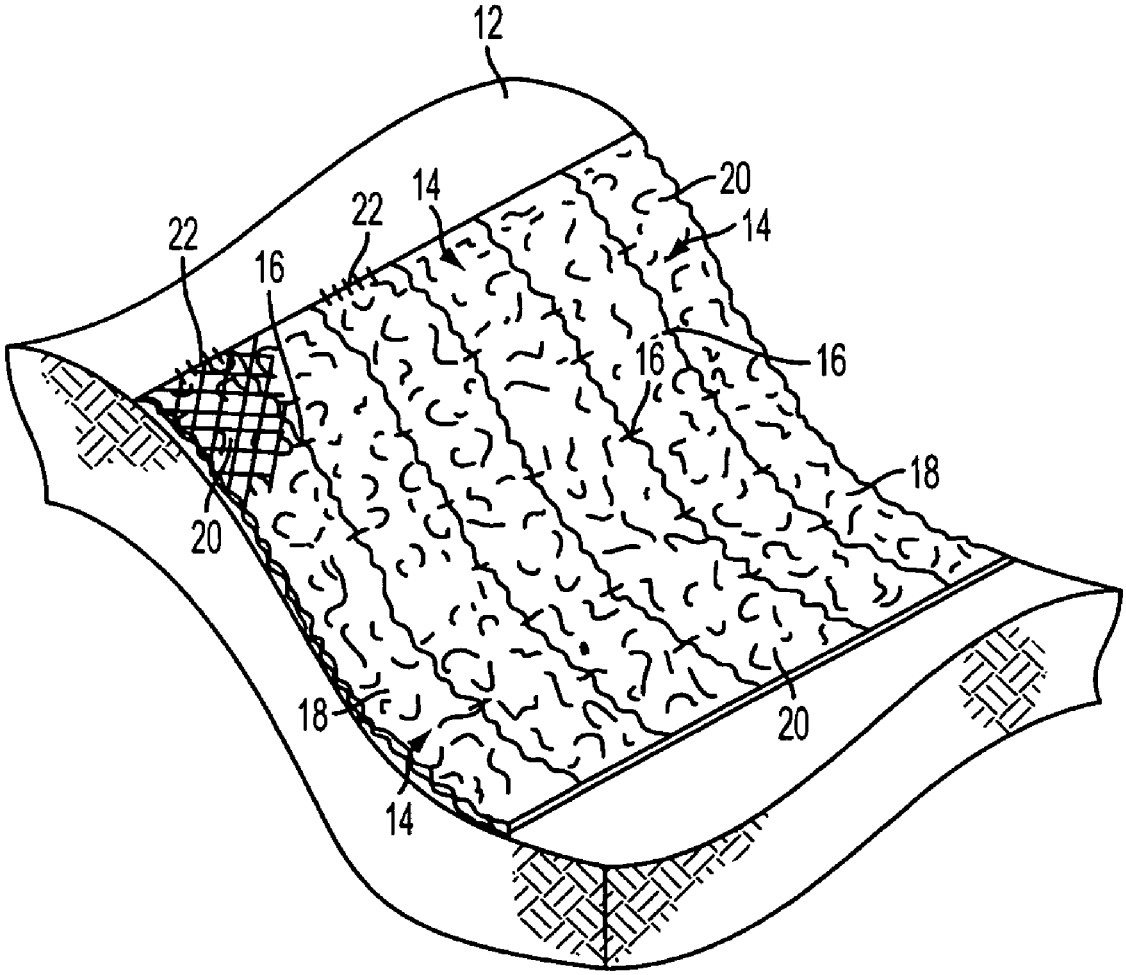
FIG. 1 is a fragmentary perspective view of a sloping ground area covered by a series of vegetation growth-enhancing erosion control blankets.

The present invention will now be described more fully hereinafter with reference to the accompanying drawings in which the preferred embodiments of the invention are shown. This invention may, however, be embodied in many different forms and should not be construed as being limited to the embodiments set forth herein. Rather, the embodiments are provided so that this disclosure is thorough and complete, and fully conveys the scope of the invention to those skilled in the art. Wherever possible, the same reference numerals are used throughout the drawings to refer to the same or like parts.

FIG. 1 is a fragmentary perspective view of a sloping ground area covered by a series of vegetation growth-enhancing erosion control blankets. In FIG. 1, there is shown, in simplified form, a section of ground having a downwardly sloping earth portion 12 normally subject to undesirable wind and water erosion forces, and upon which erosion-inhibiting ground vegetation 22 is to be grown. Covering the sloping earth portion 12 are a series of specially designed, vegetation growth enhancing, erosion control blankets 14. The erosion control blankets 14, have porous construction through which a planned-for ground vegetation 22 may readily germinate and grow.

Referring still to FIG. 1, the erosion control blankets 14 have elongated, generally rectangular configurations and are conventionally secured to one another and to the underlying sloping earth portion 12, by a series of ground staples 16. Installed in this manner, the erosion control blankets 14 shield the sloping earth portion 12 from both wind and rain until the ground vegetation 22 takes hold.

Referring still to FIG. 1, each of the erosion control blankets 14 includes an elongated rectangular mat 18 formed from fibrous material such as, for example, a plurality of elongated fibers 20 disposed in a randomly intertwined relationship. In a typical embodiment, wood fibers 20 of the excelsior or wood wool variety are preferably used and collectively define therebetween a plurality of relatively small interstitial regions through which ground vegetation 22, for example grass, may upwardly grow from the sloping earth portion 12 protectively covered by erosion control blankets 14. Each mat 18 has a substantially flat bottom surface 24, positionable directly against the sloping earth portion 12.

Figure 2:
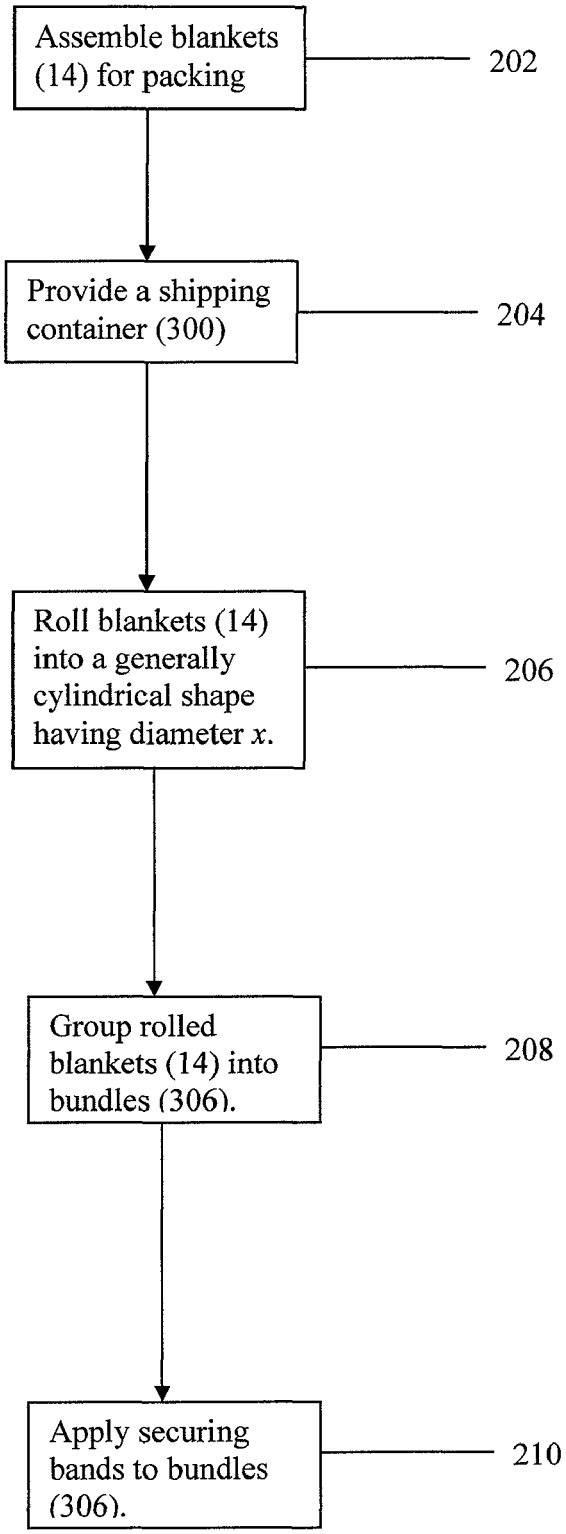
FIG. 2 illustrates a flow diagram of a packing and handling process for an erosion control blanket.
Figure 3:
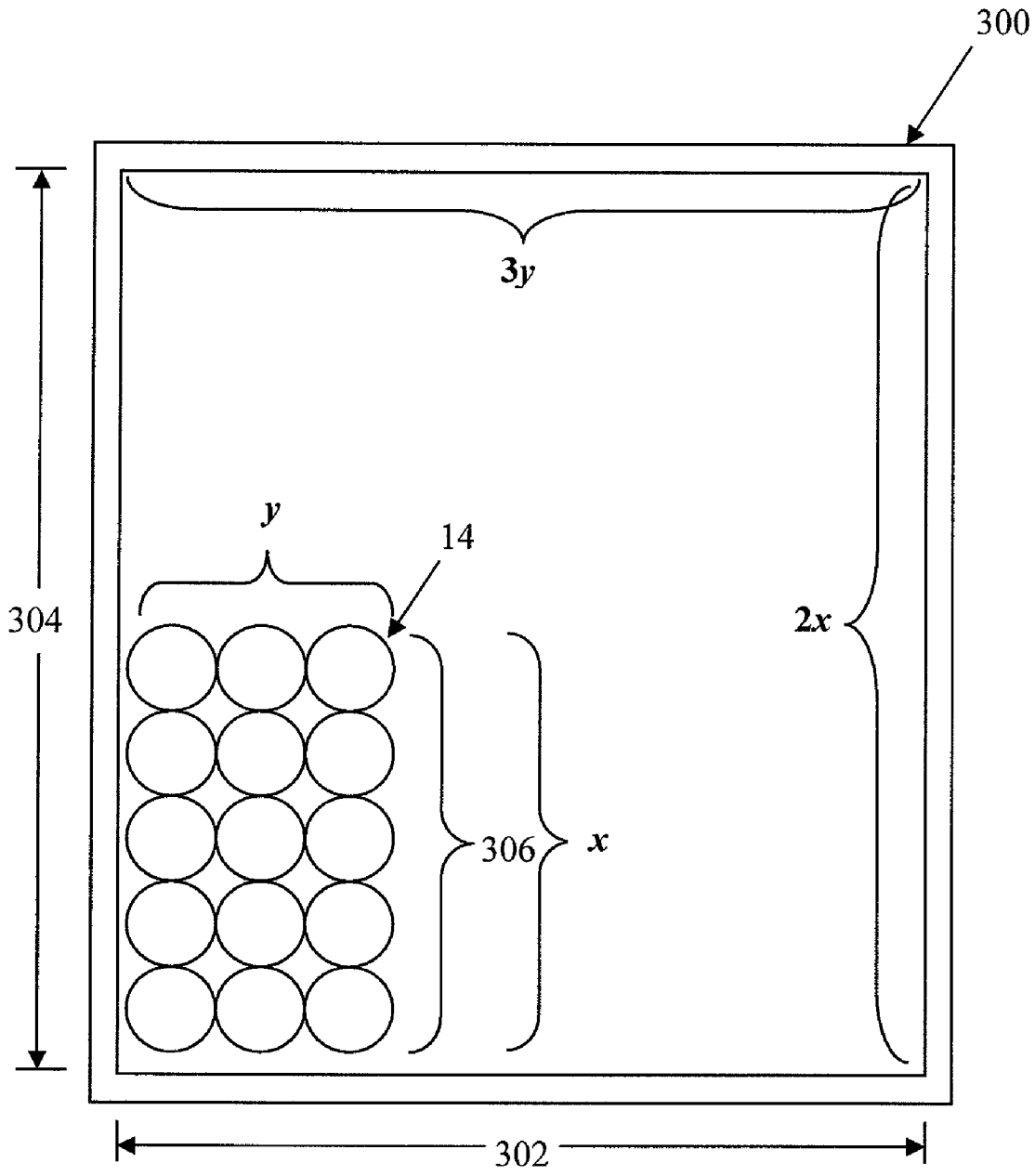
FIG. 3 is a front elevation view of a shipping container containing a bundle of rolled erosion control blankets according to FIG. 2.

FIG. 2 illustrates a flow diagram of a packing and handling for an erosion control blanket. FIG. 3 is a front elevation view of a shipping container containing a bundle of rolled erosion control blankets 14 according to FIG. 2. Referring now to FIGS. 2 and 3, a block diagram illustrates, by way of example only, the various steps of one embodiment of a packing process 300 which may be followed while preparing erosion control blankets 14 for shipment in accordance with the present invention. FIG. 3 illustrates a shipping container 300 is provided having an interior height 304 and an interior width 302, allowing bundles 306 to be inserted therein. In a typical embodiment, shipping container 300 may be any type of vessel suitable for shipping over land, air, or water, but is preferably an enclosed, van-style trailer. Interior height 304 and interior width 302 are, generally, an integer multiple of a number "x" and "y" respectively.

Referring specifically now to FIG. 2, the packing process 200 comprises the following steps: assembling erosion control blanket 14 for purposes of packing the shipment in step 202; providing a shipping container 300 in step 204; rolling each of the erosion control blanket 14 into a generally cylindrical shape in step 206; grouping the rolled erosion control blanket 14 into bundles 306, having a height of approximately a number x, whereby such a height, generally, divides substantially evenly into interior height 304 of shipping container 300 in step 208; applying securing bands or tethers about the bundles 306 in step 210 to form a packaged assembly ready for handling. By way of example, bundles 306 comprising fifteen erosion control blankets 14 are shown in FIG. 3, but any number of erosion control blankets 14 can be grouped together, provided that the height and width of the resulting bundles 306 can be approximately evenly divided into the interior height 304 and interior width 302 of shipping container 300.

Referring specifically now to FIG. 3, the rolled erosion control blankets 14 may, for example, be bound by metal bands, tethers formed of synthetic material, and/or any other binding materials, such as, fore example, rope, wire or the like providing appropriate strength without damaging the rolled erosion control blankets 14 bound therewith. It may be seen that when using a very narrow or sharp element, such as wire, it may be necessary to incorporate a flexible member (not explicitly shown), such as fabric, between the binding member (not explicitly shown) and the erosion control blanket 14 to prevent tearing and permanent damage to erosion control blanket 14.

Figure 4:
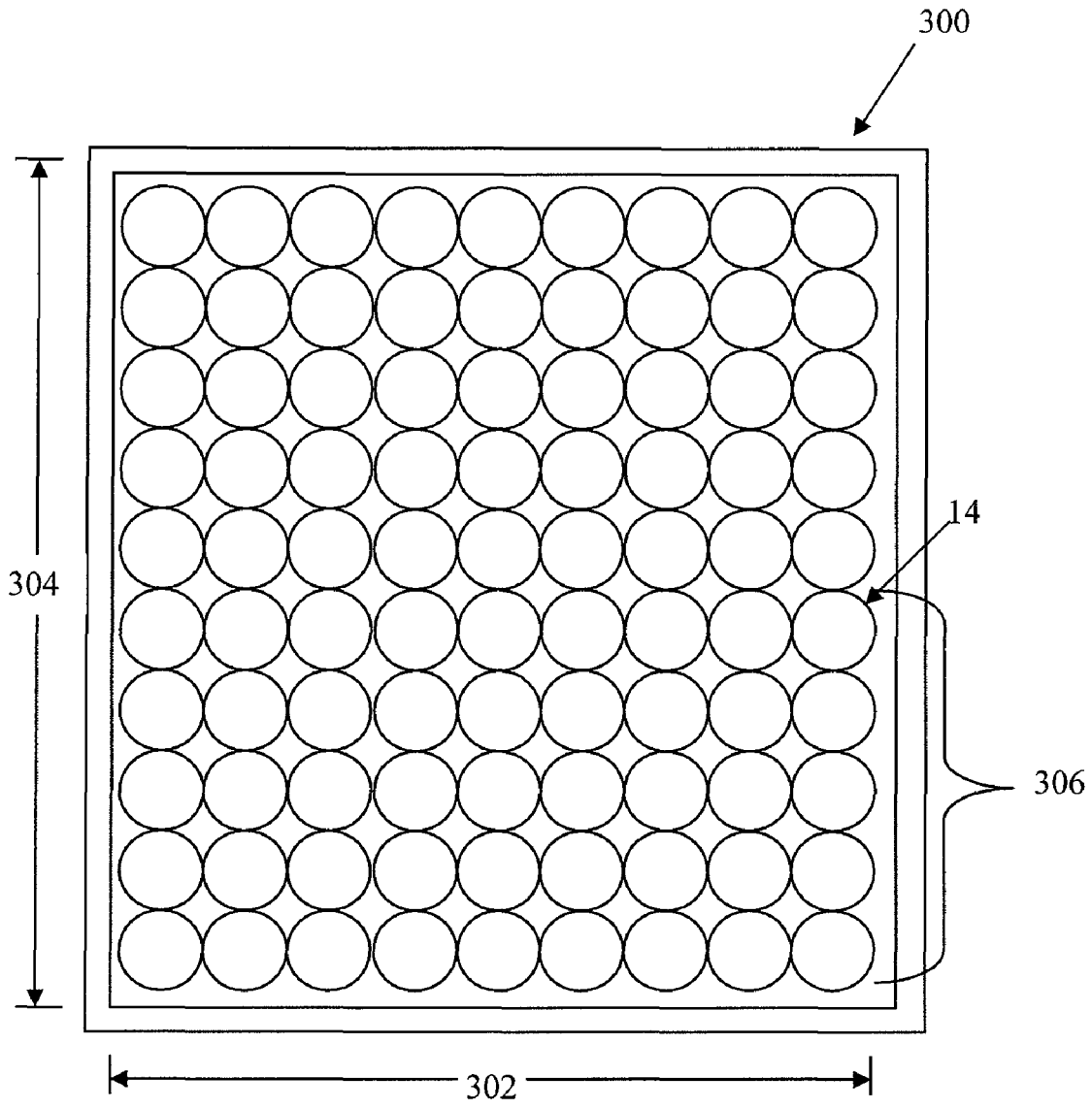
FIG. 4 is a front elevation view of a shipping container of FIG. 3 with the interior space efficiently filled with the erosion control blankets generally oriented along a length of the shipping container.

FIG. 4 is a front elevation view of a shipping container of FIG. 3 with the interior space efficiently filled with the erosion control blankets generally oriented along the length of the shipping container. FIG. 4 illustrates that the process of creating bundles having dimensions that are generally evenly divided into the interior dimensions of the shipping container provides efficient use of the interior space of shipping container 300, and reduces the time and labor associated with loading and unloading shipping container 300. It has been found that bundles 306 containing fifteen erosion control blankets 14 arranged in an array of three wide by five erosion control blankets 14 high maximizes the use of the interior space when shipping container 300 is an enclosed, van-style trailer. However, bundles 306 containing different numbers of erosion control blankets 14 have been shown to be beneficial depending on specific shipping requirements and space constraints. For example, and not by way of limitation, an array of three erosion control blankets 14 wide by two erosion control blankets 14 high also maximizes the interior space when shipping container 300 is an enclosed, van style trailer. An array of three erosion control blankets 14 wide by two erosion control blankets 14 high may also be desirable when it is necessary to ship smaller orders of erosion control or when it is beneficial to reduce the overall size of the bundles 306.

Figure 5:
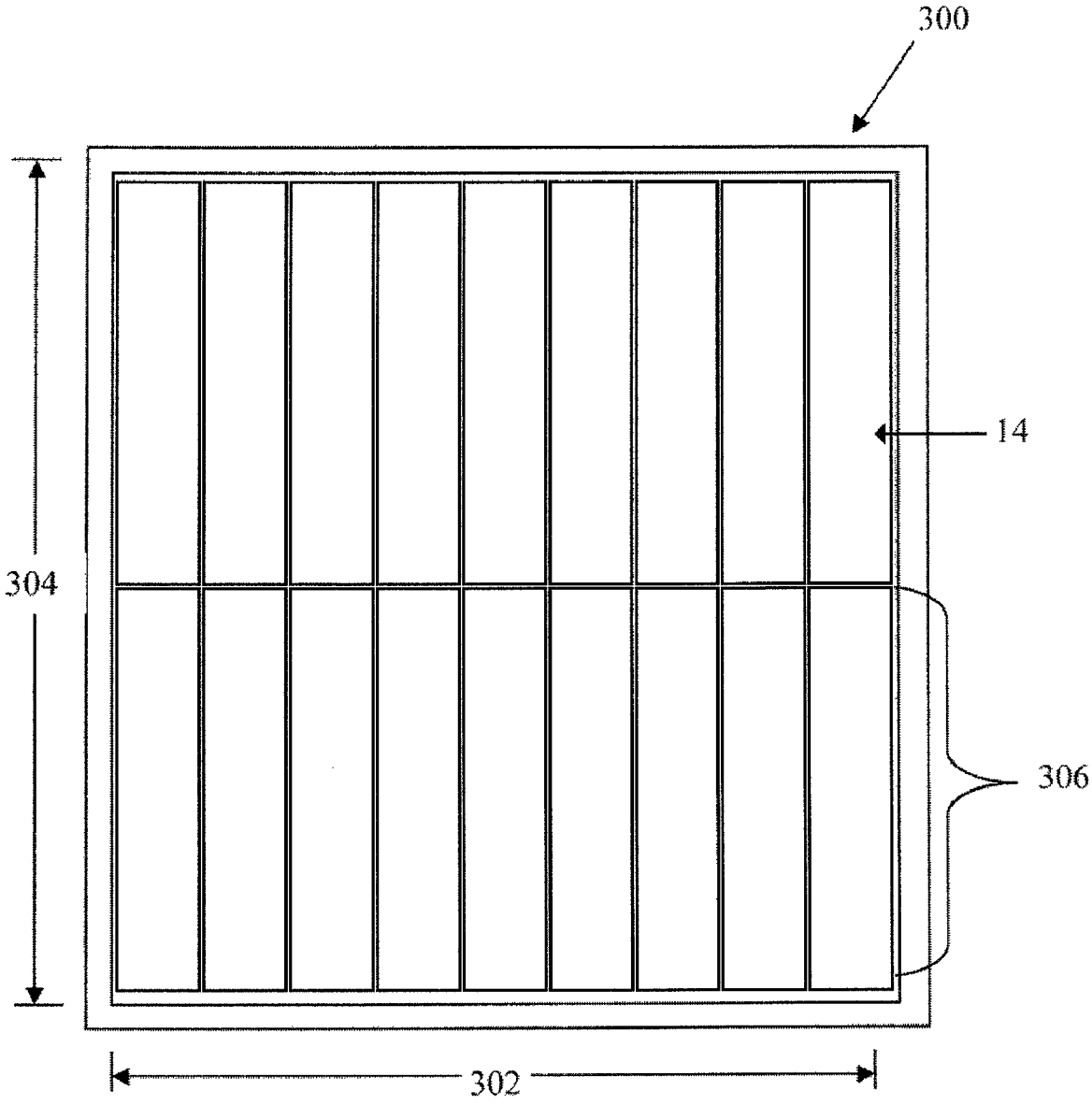
FIG. 5 is a front elevation view of a shipping container of FIG. 3 with the interior space efficiently filled with the erosion control blankets oriented generally parallel to a height of the shipping container.

FIG. 5 is a front elevation view of a shipping container of FIG. 3 with the interior space efficiently filled with the erosion control blankets oriented generally parallel to a height of the shipping container. Referring now to FIG. 5, an alternate embodiment of efficiently packing a shipping container 300 is shown. The erosion control blankets 14 are shown oriented such that the lengths of erosion control blankets 14 are generally parallel to interior height 304 of the shipping container 300. In this embodiment, bundles 306 comprise an array having dimensions that are generally evenly divided into the interior dimensions of shipping container 300. For example, and not by way of limitation, it may be desirable for bundles 306 to comprise an array of three erosion control blankets 14 wide by three erosion control blankets 14 deep. Alternately, it may be desirable for bundles 306 to comprise a different array that will make better use of the interior space of shipping container 300. It should be understood that various arrays could be utilized in order to take advantage of the size and shape of shipping container 300.

Figure 6:
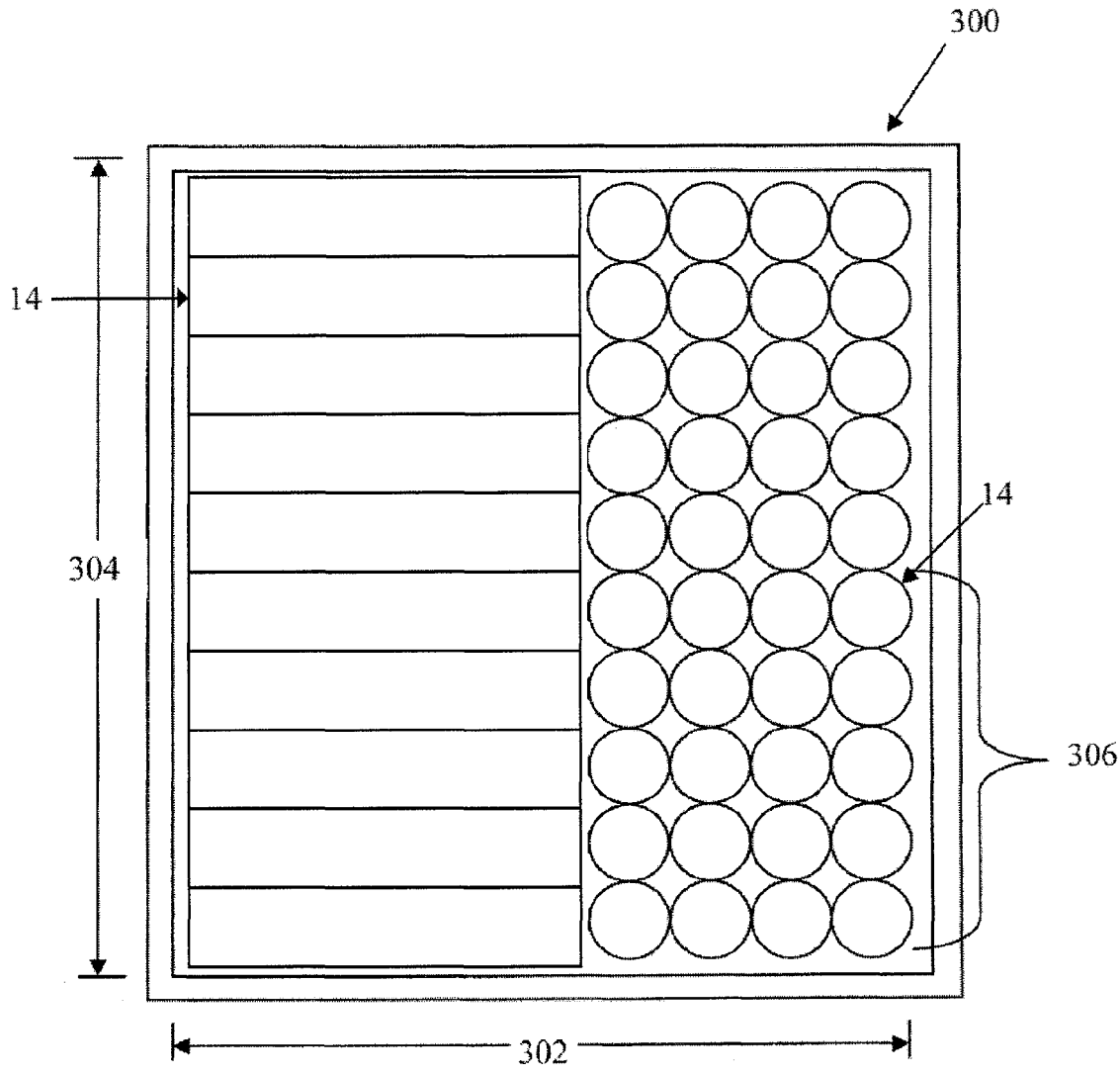
FIG. 6 is a front elevation view of a shipping container of FIG. 3 with the interior space efficiently filled with at least some erosion control blankets oriented generally parallel to the width of the shipping container and at least some of the erosion control blankets oriented generally parallel to the length of the shipping container.

FIG. 6 is a front elevation view of a shipping container of FIG. 3 with the interior space efficiently filled with at least some erosion control blankets oriented generally parallel to the width of the shipping container and at least some of the erosion control blankets oriented generally parallel to the length of the shipping container. Referring now to FIG. 6, an alternate embodiment of efficiently packaging a shipping container 300 is shown. Erosion control blankets 14 are shown in shipping container 300 oriented in two different directions. A first at least one bundle 306 of erosion control blankets 14 are oriented such that the lengths of the erosion control blankets 14 are generally parallel to interior width 302 of shipping container 300. A second at least one bundle 306 of erosion control blankets 14 are oriented such that the lengths of the erosion control blankets 14 are generally parallel to the length of shipping container 300. In this embodiment, bundles 306 comprise an array having dimensions that are generally evenly divided into the interior dimensions of shipping container 300. In this embodiment it may be desirable for bundles 306 to comprise two different arrays, one array for the erosion control blankets 14 oriented generally parallel to interior width 302 of shipping container 300 and one array for the erosion control blankets 14 oriented generally parallel to the length of shipping container 300. However, it is not necessary for the arrays to be different. For example, and not by way of limitation, it may be desirable for an array of five erosion control blankets 14 by two erosion control blankets 14. Alternately, it may be desirable for bundles 306 to comprise a different array that will make better use of the interior space of shipping container 300.

Figure 7:
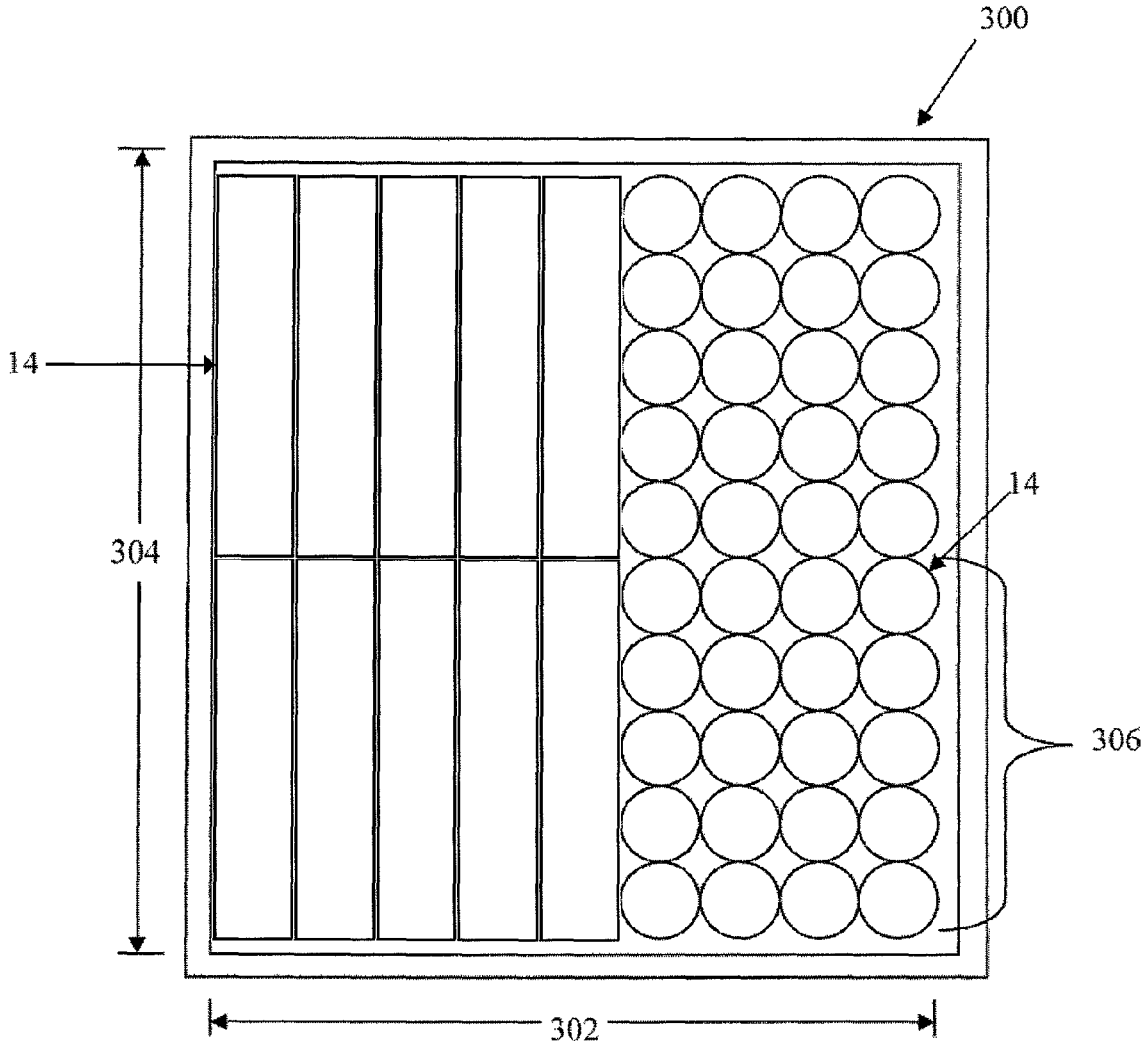
FIG. 7 is a front elevation view of a shipping container of FIG. 3 with the interior space efficiently filled with at least some erosion control blankets oriented generally parallel to the height of the shipping container and at least some erosion control blankets oriented generally parallel to the length of the shipping container.

FIG. 7 is a front elevation view of a shipping container of FIG. 3 with the interior space efficiently filled with at least some erosion control blankets oriented generally parallel to the height of the shipping container and at least some erosion control blankets oriented generally parallel to the length of the shipping container. Referring now to FIG. 7, an alternate embodiment of efficiently packaging a shipping container 300 is shown. Erosion control blankets 14 are shown in shipping container 300 oriented in two different directions. A first at least one bundle 306 of erosion control blankets 14 are oriented such that the lengths of the erosion control blankets 14 are generally parallel to interior height 304 of shipping container 300. A second at least one bundle 306 of erosion control blankets 14 are oriented such that the lengths of the erosion control blankets 14 are generally parallel to the length of shipping container 300. In this embodiment, bundles 306 comprise an array having dimensions that are generally evenly divided into the interior dimensions of shipping container 300. In this embodiment it may be desirable for bundles 306 to comprise two different arrays, one array for the erosion control blankets 14 oriented generally parallel to interior height 304 of shipping container 300 and one array for the erosion control blankets 14 oriented generally parallel to the length of shipping container 300. However, it is not necessary for the arrays to be different. For example, and not by way of limitation, it may be desirable for an array of five erosion control blankets 14 by two erosion control blankets 14. Alternately, it may be desirable for bundles 306 to comprise a different array that will make better use of the interior space of shipping container 300.

Referring now generally to FIG. 5, FIG. 6, and FIG. 7, it should be realized that any combination of orientations of erosion control blankets 14 that maximizes the use of the interior space of shipping container 300 is contemplated.

It is thus believed that the operation and construction of the present invention will be apparent from the foregoing description of the preferred embodiments. While the erosion control blanket configurations and designs as shown are described as being preferred, it will be obvious to a person of ordinary skill in the art that various changes and modifications may be made therein without departing from the spirit and scope of the invention as defined by the following claims. Therefore, the spirit and scope of the appended claims should not be limited to the description of the preferred embodiments contained therein.

What is claimed is:

1. A method of rolling, packing, handling, and delivering a plurality of erosion control blankets of a type having a flexible mat of intertwined, elongated members, in a manner maximizing an occupied space inside an enclosed freight trailer of known dimensions, the method comprising:

rolling each of a plurality of erosion control blankets into a generally cylindrical shape for subsequent assembly, packing, handling, and delivery;

grouping the rolled plurality of erosion control blankets into a plurality of bundles, each of the plurality of bundles having a height of generally x and a width of generally y;

binding each of the plurality of bundles having the height of generally x and the width of generally y for subsequent handling;

providing the enclosed freight trailer of known dimensions including an interior width, an interior height, and an interior length, wherein the interior width is generally an integer multiple of a number (3y) and the interior height is generally an integer multiple of a number (2x); and placing the plurality of bundles having the height of generally x and the width of generally y inside the enclosed freight trailer such that the height of the plurality of bundles is substantially aligned with the height of the enclosed freight trailer and the width of the bundles is substantially aligned with the width of the enclosed freight trailer thereby maximizing the occupied space inside the enclosed freight trailer.

2. The method according to claim 1, wherein each of the plurality of bundles comprises fifteen erosion control blankets.

3. The method according to claim 2, wherein a height of each of the plurality of bundles is approximately one half of the interior height of the enclosed freight trailer.

4. The method according to claim 2, wherein a width of each of the plurality of bundles is approximately one third of the interior width of the enclosed freight trailer.

5. The method according to claim 2, wherein each of the plurality of bundles has both a height that is approximately one half of the interior height of the enclosed freight trailer and a width that is approximately one third of the interior width of the enclosed freight trailer.

6. The method according to claim 1, wherein each of the plurality of bundles comprises six erosion control blankets.

7. The method according to claim 6, wherein a height of each of the plurality of bundles is approximately one fifth of the interior height of the shipping container.

8. The method according to claim 6, wherein a width of each of the plurality of bundles is approximately one third of the interior width of the enclosed freight trailer.

9. The method according to claim 6, wherein each of the plurality of bundles has both a height that is approximately one fifth of the interior height of the enclosed freight trailer and a width that is approximately one third of the interior width of the enclosed freight trailer.

10. The method according to claim 1, wherein a geometry of the plurality of bundles generally maximizes an occupied space inside the enclosed freight trailer.

11. The method according to claim 1, wherein the step of binding the plurality of bundles comprises providing at least one band having opposite ends and securing the opposite ends around the plurality of bundles of rolled plurality of erosion control blankets.

12. The method according to claim 11, wherein the at least one band is provided in a metal configuration.

13. The method according to claim 11, wherein the at least one band is provided in a synthetic material configuration.

14. A method of rolling, packing, handling, and delivering a plurality of erosion control blankets of a type having a flexible mat of intertwined, elongated members, in a manner maximizing an occupied space inside a shipping container of known dimensions, the method comprising:

rolling each of a plurality of erosion control blankets into a generally cylindrical shape for subsequent assembly, packing, handling, and delivery;

grouping the rolled plurality of erosion control blankets into a plurality of bundles each, each of the plurality of bundles having a height of generally x and a width of generally y;

binding each of the plurality of bundles having a height of generally x and a width of generally y for subsequent handling;

providing the shipping container of known dimensions including an interior width and an interior height, wherein the interior width is generally an integer multiple of a number 3y and the interior height is generally an integer multiple of a number 2x; and placing the plurality of bundles having a height of generally x and a width of generally y inside the shipping container such that the height of the plurality of bundles is substantially aligned with the interior height of the shipping container and the width of the bundles is substantially aligned with the interior width of the shipping container thereby maximizing the occupied space inside the shipping container.

15. The method according to claim 14, wherein the shipping container comprises an enclosed freight trailer.

16. The method according to claim 14, wherein the shipping container comprises a vessel adapted for shipping by air or sea.

17. The method according to claim 14, wherein a geometry of the plurality of bundles generally maximizes an occupied space inside the shipping container.

18. The method according to claim 14, wherein each of the plurality of bundles comprises fifteen erosion control blankets.

19. The method according to claim 14, wherein each of the plurality of bundles comprises six erosion control blankets.

20. The method according to claim 14, wherein the step of binding the plurality of bundles of rolled plurality of erosion control blankets comprises providing at least one band having opposite ends and securing the opposite ends around the plurality of bundles of the rolled plurality of erosion control blankets.

21. The method according to claim 14, wherein the band is provided in a metal configuration.

22. The method according to claim 14, wherein the band is provided in a synthetic material configuration.

23. A method of rolling, packing, handling, and delivering a plurality of erosion control blankets of a type having a flexible mat of intertwined, elongated members, in a manner maximizing an occupied space inside a shipping container of known dimensions, the method comprising:

producing rolled erosion control blankets, the rolled erosion control blankets having a length that is proportional to an interior length of the shipping container and a diameter that is proportional to an interior height of the shipping container;

grouping the rolled erosion control blankets into a plurality of bundles, each of the plurality of bundles having a height, width, and length that is generally evenly divided into the interior height, the interior length, and an interior width of the shipping container;

binding each of the plurality of bundles having a height, width, and length that is generally evenly divided into the interior height, width, and length of the shipping container for subsequent handling;

providing the shipping container of known dimensions including an interior width, an interior height, and an interior length;

placing the plurality of bundles having a height, width, and length that is generally evenly divided into the interior height, width, and length of the shipping container inside the shipping container; and maximizing the occupied space inside the shipping container by aligning the length of the plurality of bundles havin a height, width, and length that is generally evenly divided into the interior height, width, and length of the shipping container with at least one of the interior height of the shipping container, the interior length of the shipping container, or the interior width of the shipping container.

24. The method according to claim 23, wherein a geometry of the plurality of bundles generally maximizes an occupied space inside the shipping container.

25. The method according to claim 23, wherein the plurality of bundles are oriented with a length of the plurality of erosion control blankets generally parallel to the interior width of the shipping container.

26. The method according to claim 23, wherein the plurality of bundles are oriented with a length of the plurality of erosion control blankets generally parallel to the interior height of the shipping container.

27. The method according to claim 23, wherein the plurality of bundles are oriented with a length of the plurality of erosion control blankets generally parallel to the interior width of the shipping container.

28. The method according to claim 23, wherein at least one of the plurality of bundles is oriented such that a length of the erosion control blankets is generally parallel to the interior width of the shipping container and at least one of the plurality of bundles is oriented such that the length of the erosion control blankets is generally parallel to the interior length of the shipping container.

29. The method according to claim 23, wherein at least one of the plurality of bundles is oriented such that the length of the plurality of erosion control blankets is generally parallel to the interior height of the shipping container and at least one of the plurality of bundles is oriented such that the length of the plurality of erosion control blankets is generally parallel to the interior length of the shipping container.

30. The method according to claim 23, wherein each of the plurality of bundles has a height that is approximately one half of the interior height of the shipping container.

31. The method according to claim 23, wherein each of the plurality of bundles has a width that is approximately one third of the interior width of the shipping container.

32. The method according to claim 23, wherein the shipping container comprises an enclosed freight trailer.

33. The method according to claim 23, wherein the shipping container comprises a vessel adapted for shipping by air or sea.

* * * * *